US009341352B2

(12) United States Patent
Huang et al.

(10) Patent No.: US 9,341,352 B2
(45) Date of Patent: May 17, 2016

(54) LIGHTING SYSTEM THAT CAN CHANGE LIGHT EMITTING CHARACTERISTIC AND LIGHTING DEVICE AND LAMP HOLDER OF THE LIGHTING SYSTEM

(71) Applicant: Radiant Opto-Electronics Corporation, Kaohsiung (TW)

(72) Inventors: Guo-Hao Huang, Kaohsiung (TW); Pai-Ho Hsu, Kaohsiung (TW); Kun-Feng Chen, Kaohsiung (TW)

(73) Assignee: Radiant Opto-Electronics Corporation, Kaohsiung (TW)

( * ) Notice: Subject to any disclaimer, the term of this patent is extended or adjusted under 35 U.S.C. 154(b) by 139 days.

(21) Appl. No.: 14/222,025

(22) Filed: Mar. 21, 2014

(65) Prior Publication Data

US 2015/0029708 A1 Jan. 29, 2015

(30) Foreign Application Priority Data

Jul. 24, 2013 (TW) ..... 102126495 A

(51) Int. Cl.

| | |
|---|---|
| ***F21V 19/00*** | (2006.01) |
| ***F21V 21/02*** | (2006.01) |
| ***F21V 19/02*** | (2006.01) |
| ***F21S 4/00*** | (2016.01) |

(Continued)

(52) U.S. Cl.

CPC ..... *F21V 19/02* (2013.01); *F21S 4/008* (2013.01); *F21S 8/037* (2013.01); *F21V 21/02* (2013.01); *F21Y 2101/02* (2013.01); *F21Y 2103/003* (2013.01)

(58) Field of Classification Search

CPC ..... F21V 19/008; F21V 19/02; F21V 21/02; F21S 4/008; F21S 8/037; F21Y 2101/02; F21Y 2103/003

See application file for complete search history.

(56) References Cited

U.S. PATENT DOCUMENTS 5,437,504 A * 8/1995 Halvatzis ..... A47F 3/001 312/223.5
5,735,498 A * 4/1998 Jue ..... F21V 21/02 248/222.12

(Continued)

FOREIGN PATENT DOCUMENTS

CN 201184568 Y 1/2009
CN 201288974 Y 8/2009

(Continued)

OTHER PUBLICATIONS

Patent Translate by EPO and Google of Description of WANG et al (CN 201288974 Y), Aug. 12, 2009, pp. 1-7.*

(Continued)

*Primary Examiner* — Alan Cariaso
(74) *Attorney, Agent, or Firm* — Frommer Lawerence & Haug LLP

(57) ABSTRACT

A lighting system includes a carrier unit, and a lamp holder including a holder plate for mounting of a light emitting unit, and a first positioning plate and a second positioning plate extending from the holder plate and spaced apart from each other. The holder plate is disposable at a first or second position when the first or second positioning plate is connected to the carrier unit. A light emitting characteristic of the light emitting unit when the holder plate is in the first position is different from a light emitting characteristic of the light emitting unit when the holder plate is in the second position.

17 Claims, 12 Drawing Sheets

(51) Int. Cl.

| | |
|---|---|
| *F21S 8/00* | (2006.01) |
| *F21Y 101/02* | (2006.01) |
| *F21Y 103/00* | (2016.01) |

(56) References Cited

U.S. PATENT DOCUMENTS

| | | | | | |
|---|---|---|---|---|---|
| 5,816,687 | A | * | 10/1998 | Tapp | F21S 4/003 362/248 |
| 6,007,217 | A | * | 12/1999 | Ferrier | F21V 15/01 362/220 |
| 6,135,618 | A | * | 10/2000 | Tai | F21S 8/033 220/3.7 |
| 2009/0200966 | A1 | * | 8/2009 | Whitehouse | A47B 97/00 315/309 |
| 2010/0254146 | A1 | | 10/2010 | McCanless | |
| 2012/0300481 | A1 | | 11/2012 | Kim et al. | |
| 2013/0039052 | A1 | | 2/2013 | Forteza et al. | |

FOREIGN PATENT DOCUMENTS

| | | | |
|---|---|---|---|
| CN | 201885156 | U | 6/2011 |
| CN | 201983221 | U | 9/2011 |
| CN | 202546662 | U | 11/2012 |
| CN | 102947644 | A | 2/2013 |
| JP | 2010-0142435 | A | 7/2010 |
| TW | M442471 | U | 12/2012 |

OTHER PUBLICATIONS

Search Report appended in an Office Action issued to Chinese counterpart application No. 201310313501.0 by the State Intellectual Property Office of the P.R.C. on Sep. 3, 2014 along with an English translation thereof.

* cited by examiner

LIGHTING SYSTEM THAT CAN CHANGE LIGHT EMITTING CHARACTERISTIC AND LIGHTING DEVICE AND LAMP HOLDER OF THE LIGHTING SYSTEM

CROSS REFERENCE TO RELATED APPLICATION

This application claims priority of Taiwanese Application No. 102126495, filed on Jul. 24, 2013.

BACKGROUND OF THE INVENTION

1. Field of the Invention

This invention relates to a lighting device, more particularly to a lighting system that can change a light emitting characteristic, and a lighting device and a lamp holder of the lighting system.

2. Description of the Related Art

A conventional lighting device cannot adjust the direction of the emitted light, so that the emitted light is likely to project onto unnecessary locations, resulting in loss of light. To overcome the aforesaid problem, a lighting device 1, as shown in FIG. 1, has been developed. The lighting device 1 includes a lamp holder 11, a pivot unit 12 connected to the lamp holder 11, and a lamp tube 13 disposed on the pivot unit 12. As shown in FIGS. 2 to 4, through the pivot unit 12, the position of the lamp tube 13 can be adjusted relative to the lamp holder 11, thereby achieving the effect of changing the direction of the emitted light.

However, the lighting device 1 not only has many components so that the assembly thereof is difficult, but also is not aesthetic. Hence, the lighting device 1 is only suitable for use in a concealed manner.

SUMMARY OF THE INVENTION

Therefore, the object of the present invention is to provide a lighting system that is capable of overcoming the aforesaid drawbacks of the prior art. A lighting device and a lamp holder of the lighting system are also provided.

According to one aspect of this invention, a lighting device comprises a lamp holder and a light emitting unit. The lamp holder includes a holder plate extending in a longitudinal direction and having two opposite longitudinal sides, and a first positioning plate and a second positioning plate extending from the holder plate and spaced apart from each other. The light emitting unit is mounted on the holder plate. The first and second positioning plates are selectively used for connection with a carrier unit. The holder plate is disposed at a first position when the first positioning plate is connected to the carrier unit, and is disposed at a second position when the second positioning plate is connected to the carrier unit. A light emitting characteristic of the light emitting unit when the holder plate is in the first position is different from a light emitting characteristic of the light emitting unit when the holder plate is in the second position.

According to another aspect of this invention, a lighting system comprises a carrier unit, and at least one lighting device removably supported on the carrier unit and including a lamp holder and a light emitting unit. The lamp holder includes a holder plate extending in a longitudinal direction and having two opposite longitudinal sides, and a first positioning plate and a second positioning plate extending from the holder plate and spaced apart from each other. The light emitting unit is mounted on the holder plate. The first and second positioning plates are selectively and removably connected to the carrier unit. The holder plate is disposed at a first position when the first positioning plate is connected to the carrier unit, and is disposed at a second position when the second positioning plate is connected to the carrier unit. A light emitting characteristic of the light emitting unit when the holder plate is in the first position is different from a light emitting characteristic of the light emitting unit when the holder plate is in the second position.

According to still another aspect of this invention, a lamp holder comprises a holder plate extending in a longitudinal direction and having two opposite longitudinal sides; and a first positioning plate and a second positioning plate extending from the holder plate and spaced apart from each other. The first and second positioning plates are selectively used for connection with a carrier unit. The holder plate is disposed at a first position when the first positioning plate is connected to the carrier unit, and is disposed at a second position when the second positioning plate is connected to the carrier unit.

The efficiency of this invention resides in that through the configurations of the first and second positioning plates, the holder plate of the lamp holder of the lighting system of the present invention can be disposed between the first and second positions so as to change the light emitting characteristic of the lighting system. Moreover, the lighting system of this invention has simple components and structure, so that the manufacturing cost thereof can be saved, and the aesthetics, practicality and value of the lighting device can be enhanced.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
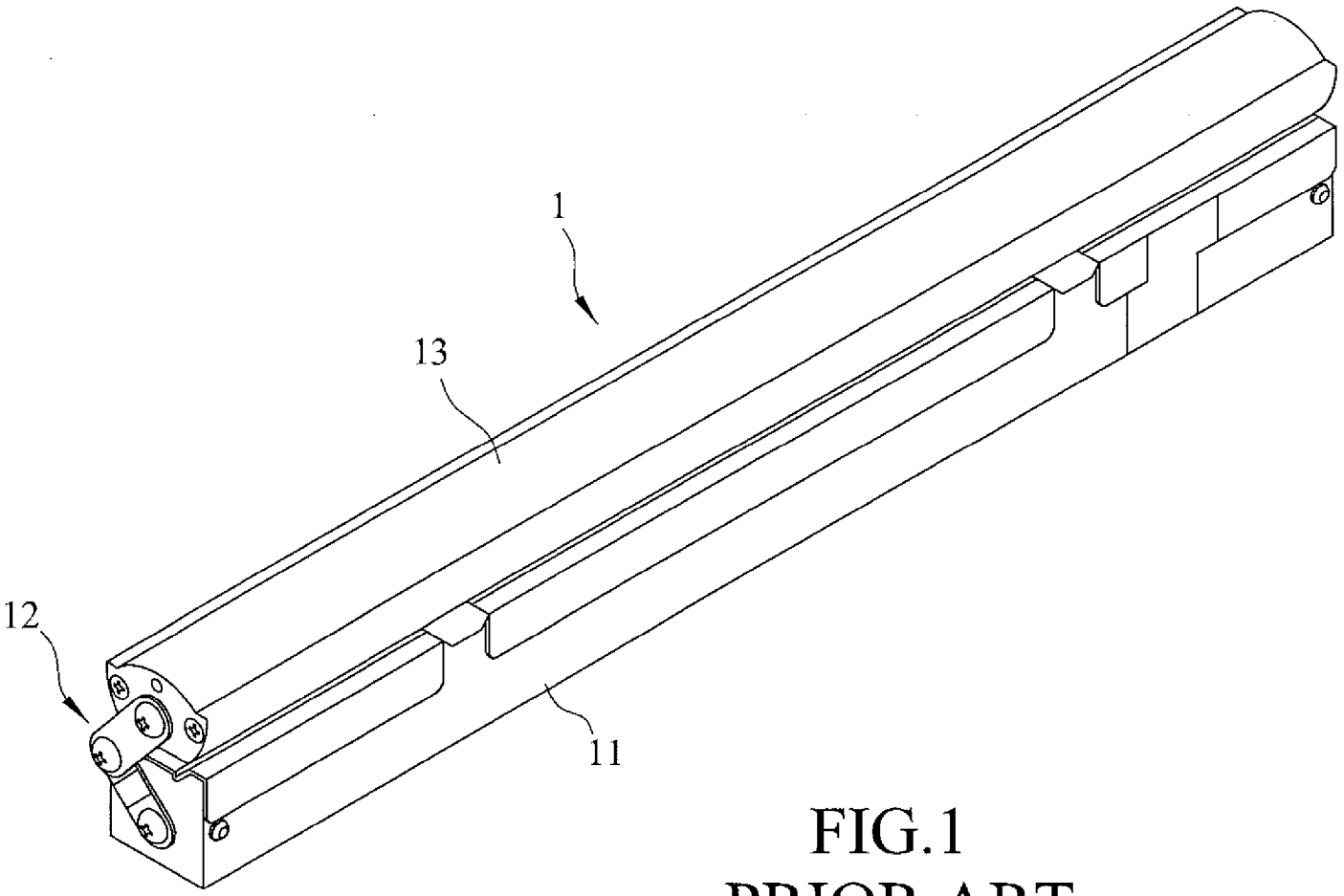
FIG.1 PRIOR ART
FIG. 1 is a perspective view of an existing lighting device.
Figure 2:
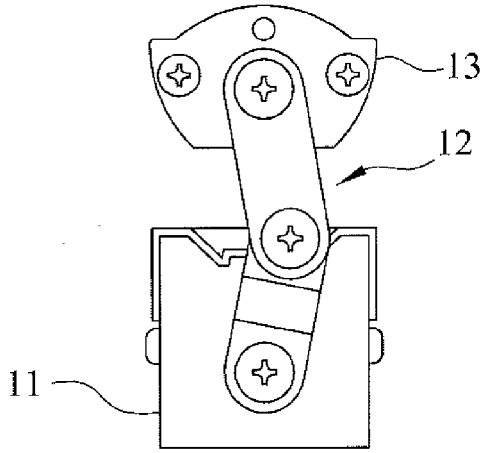
FIG.2 PRIOR ART
FIGS. 2 to 4 illustrate different positions of a lamp tube relative to a lamp holder of the lighting device of FIG. 1.
Figure 3:
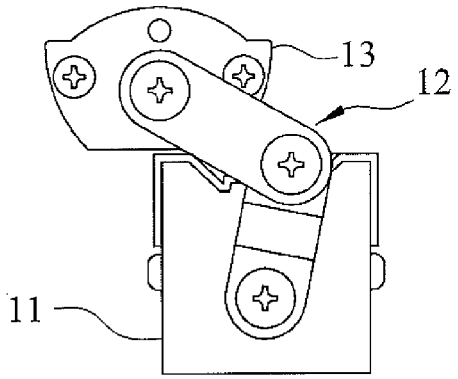
FIG.3 PRIOR ART
Figure 4:
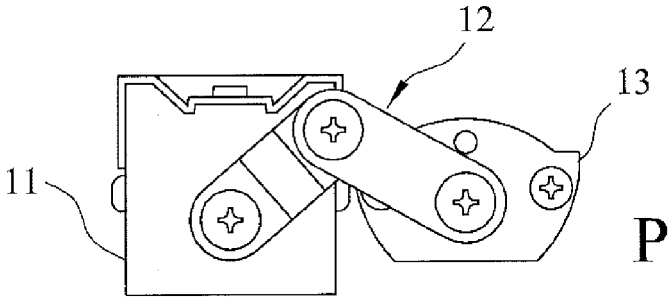
FIG.4 PRIOR ART

Referring to FIGS. 5 to 9, the preferred embodiment of a lighting system according to the present invention comprises a lighting device 2 and a carrier unit 3.

The lighting device 2 includes a lamp holder 22, a light emitting unit 23, two end covers 224 and a lampshade 24.

The lamp holder 22 includes a holder plate 221 extending in a longitudinal direction (X) and having two opposite longitudinal sides (LS) and two opposite transverse ends (TE) interconnecting the longitudinal sides (LS), a first positioning plate 222 that extends longitudinally, that has one end connected to one of the longitudinal sides (LS) of the holder plate 221 and that extends inclinedly from the one of the longitudinal sides (LS) at a first angle (A) with respect to the holder plate 221, and a second positioning plate 223 that extends longitudinally, that has one end connected to the other one of the longitudinal sides (LS) of the holder plate 221 and that extends inclinedly from the other one of the longitudinal sides (LS) at a second angle (B) with respect to the holder plate 221. The second angle (B) is different from the first angle (A). Each of the first and second positioning plates 222, 223 further has another end opposite to the one end thereof. The another ends of the first and second positioning plates 222, 223 extend toward each other, and are extrapolated to intersect each other and form a right angle therebetween. Each of the first and second positioning plates 222, 223 further has a width (W1, W2) between the one end and the another end thereof. The width (W1) of the first positioning plate 222 is larger than that of the second positioning plate 223.

The light emitting unit 23 is mounted on the holder plate 221.

The end covers 224 are respectively and removably connected to the transverse ends (TE) of the holder plate 221.

The lampshade 24 is connected to the holder plate 221 and covers the light emitting unit 23.

The carrier unit 3 includes a carrier plate 31 extending in the longitudinal direction (X), having an L-shaped cross section and including a first carrier plate 311 and a second carrier plate 312 angled to each other. The lighting device 2 is removably supported on the carrier plate 31.

In this embodiment, the first carrier plate 311 is used for connection with a support, such as a wall surface 100 (see FIG. 14), and the carrier unit 3 further includes two clamps 32 that are spaced apart from each other along the longitudinal direction (X). Each of the clamps 32 includes a mounting portion 321, a clamping portion 322 offset from the mounting portion 321, a bent portion 323 interconnecting the mounting portion 321 and the clamping portion 322, and a fastener 324 that extends through the mounting portion 321 and that engages the first carrier plate 311 to thereby fix the clamp 32 on the first carrier plate 311. The clamping portion 322 is spaced apart from the first carrier plate 311 to form a clamping space 325. A selected one of the first and second positioning plates 222, 223 is insertable into the clamping space 325.

It should be noted that the number of the clamp 32 may be adjusted according to actual requirement, and may be one only.

Figure 6:
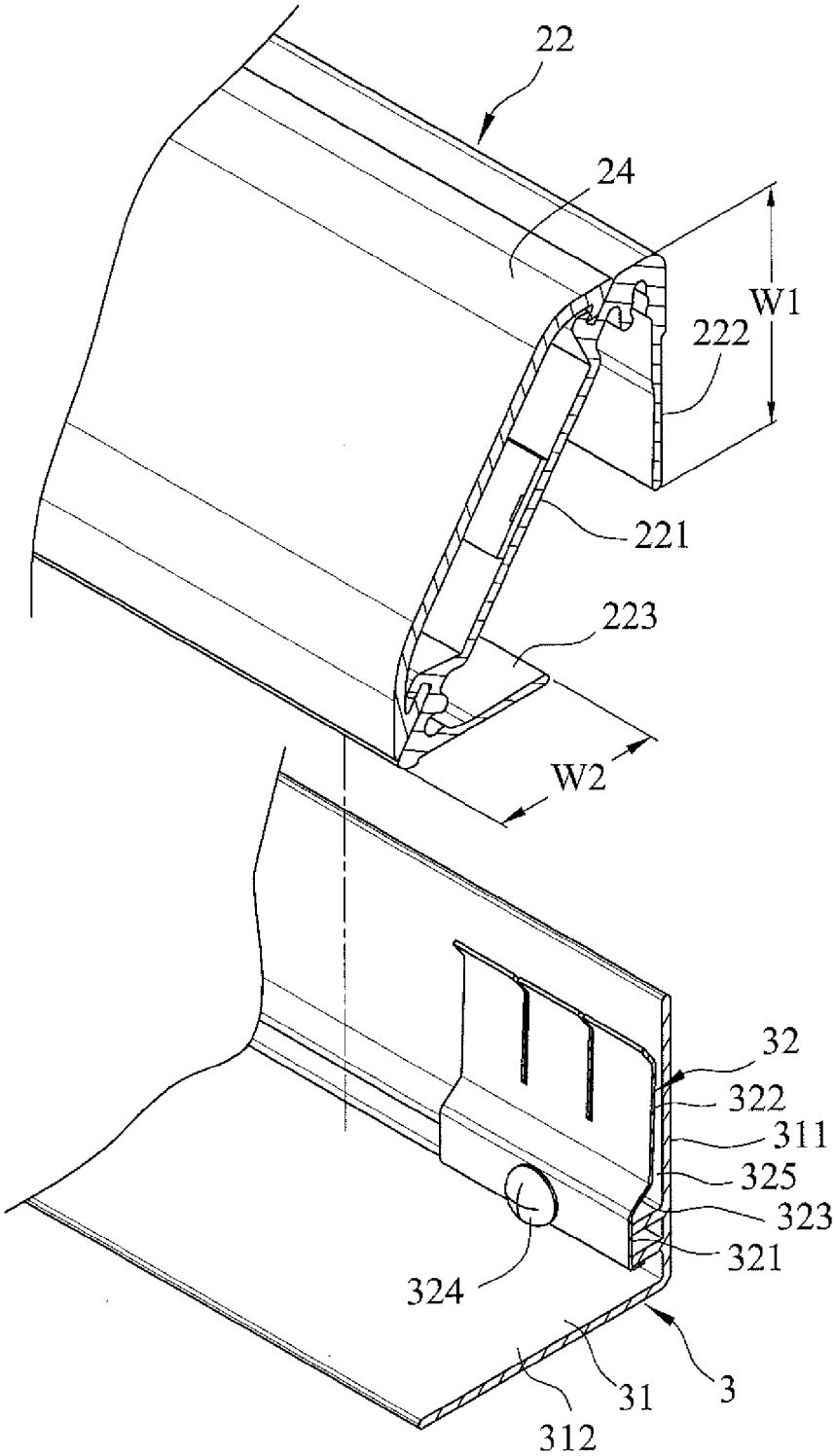
FIG. 6 is an enlarged fragmentary partly exploded perspective view of the preferred embodiment.
Figure 7:
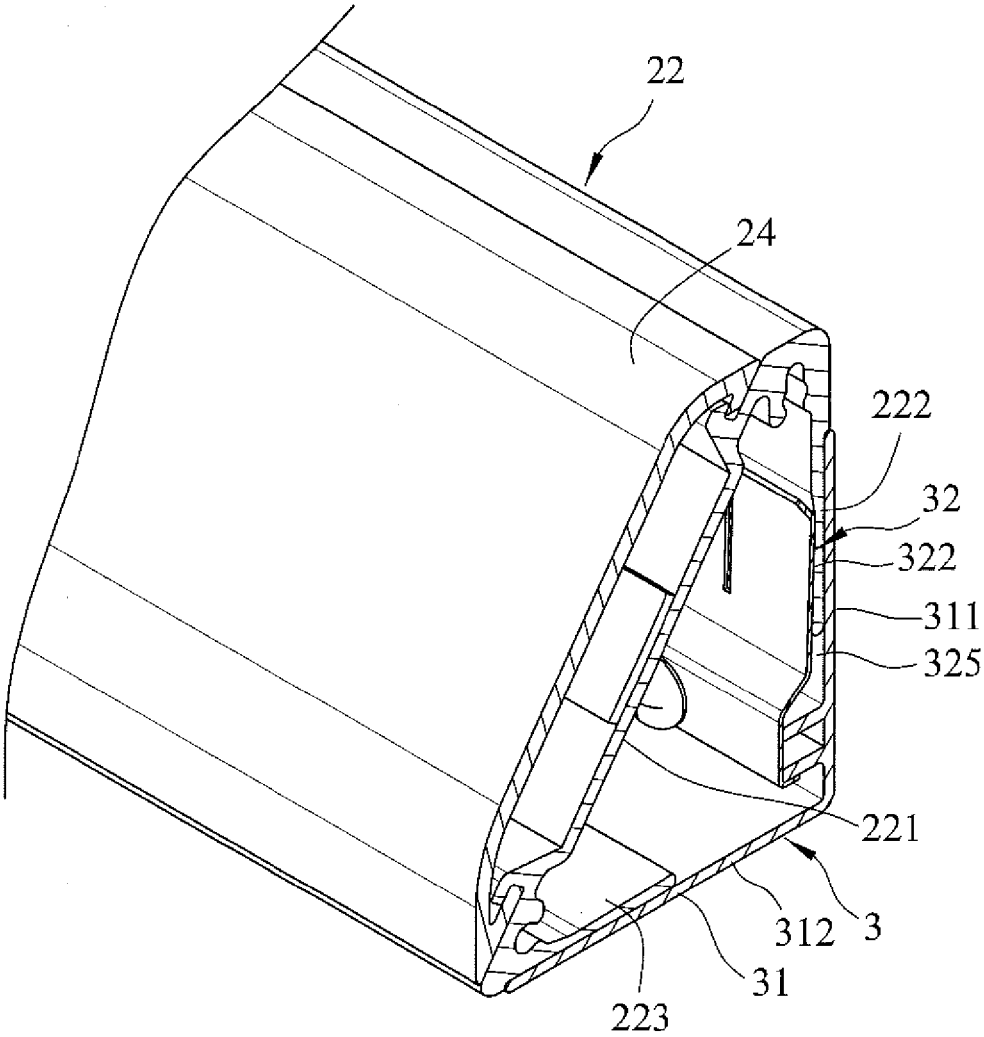
FIG. 7 is an assembled perspective view of FIG. 6.
Figure 8:
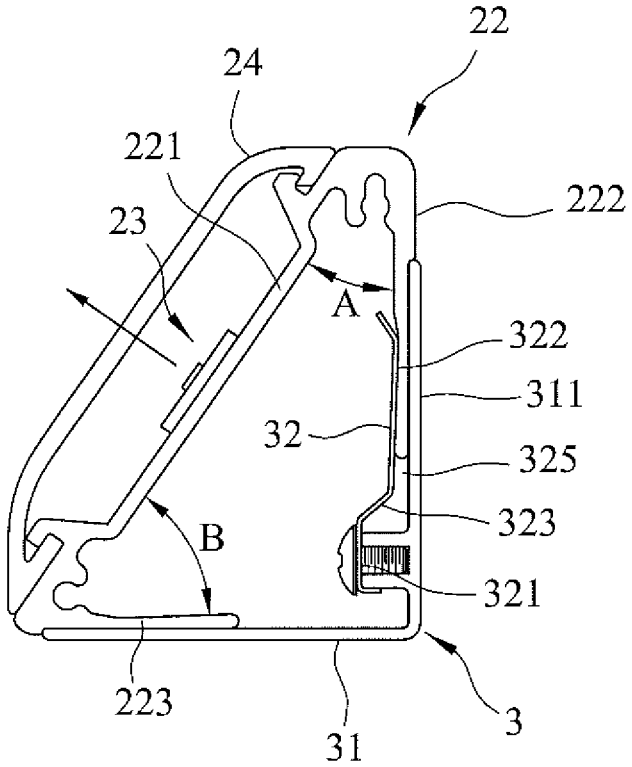
FIG. 8 is a schematic side view of the preferred embodiment, illustrating a holder plate of a lamp holder of a lighting device in a first position.
Figure 9:
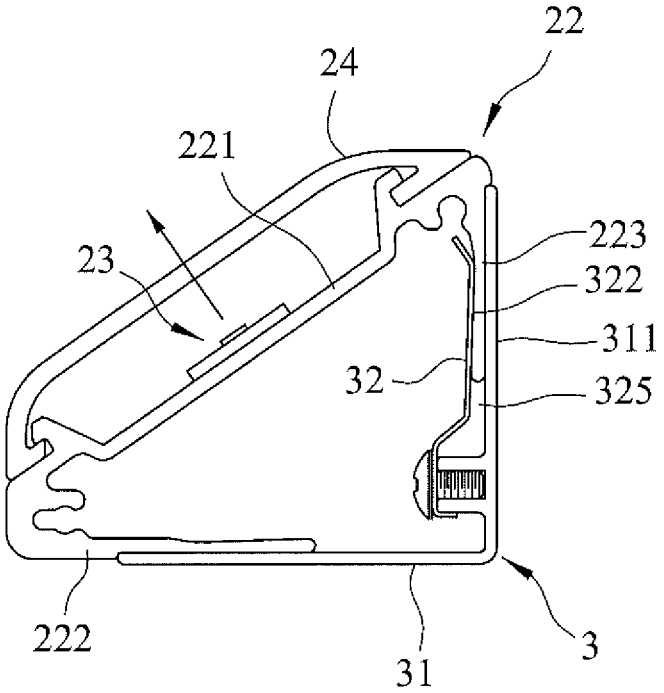
FIG. 9 is another schematic side view of the preferred embodiment, illustrating the holder plate of the lamp holder in a second position.

With reference to FIGS. 6 to 8, when the first positioning plate 222 is inserted into the clamping space 325 and is positioned between the first carrier plate 311 and the clamping portion 322, the holder plate 221 is disposed at a first position relative to the carrier plate 31. To change the position of the holder plate 221, the lamp holder 22 is pulled so as to remove the first positioning plate 222 from the clamping space 325, and is then turned so that the second positioning plate 223 can be inserted into the clamping space 325 and be positioned between the first carrier plate 311 and the clamping portion 322, thereby placing the holder plate 221 at a second position relative to the carrier plate 31, as shown in FIG. 9. A light emitting characteristic of the light emitting unit 23 when the holder plate 221 is in the first position is different from a light emitting characteristic of the light emitting unit 23 when the holder plate 221 is in the second position, as shown by the arrows which stand for two different kinds of light orient direction in FIGS. 8 and 9, respectively. It should be noted that, in this embodiment, the effect of changing the light emitting characteristic of the light emitting unit 23 is achieved by using the first and second positioning plates 222, 223 which have different angles with respect to the holder plate 221 and which have different widths (W1, W2). In this embodiment the light emitting characteristic is the light orient direction, however it is not the light orient direction only but also the height of the light source or the position of the light source, therefore the light emitting characteristic should not be limited to what is disclosed herein. The effect of changing the light emitting characteristic of the light emitting unit 23 may also be achieved by changing the angles, the sizes, and the disposition positions of the first and second positioning plates 222, 223, and is not limited to what is disclosed herein.

Figure 10:
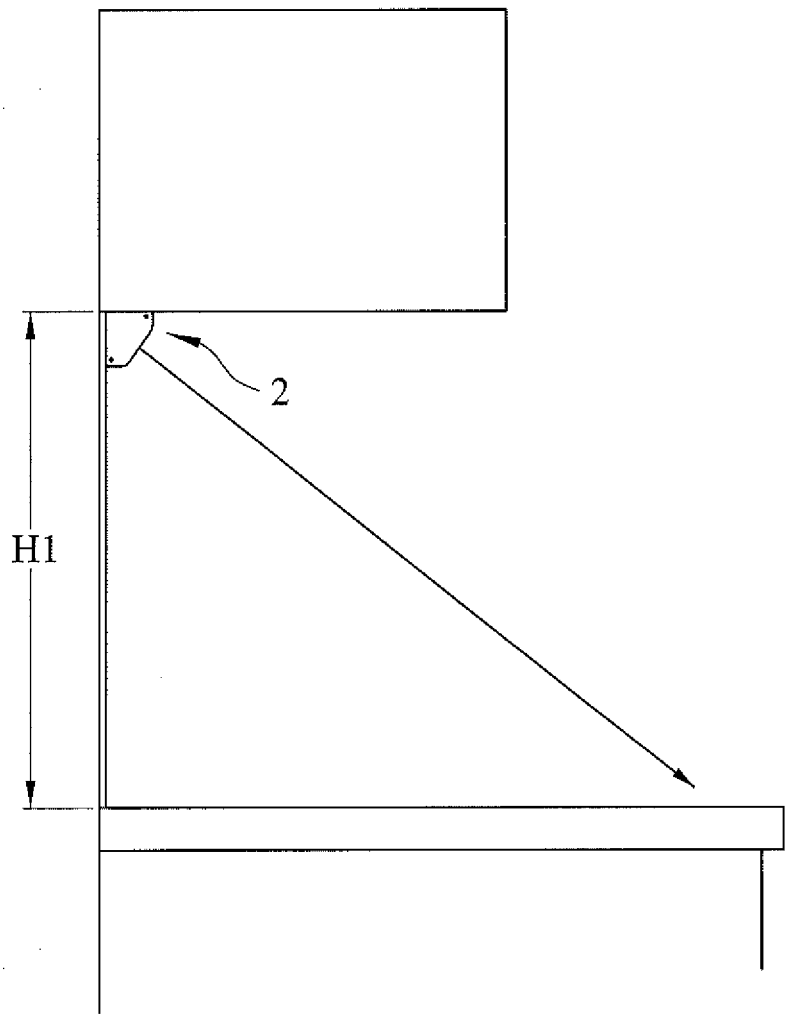
FIGS. 10 and 11 are schematic diagrams, illustrating the lighting device of the preferred embodiment installed in different heights.
Figure 11:
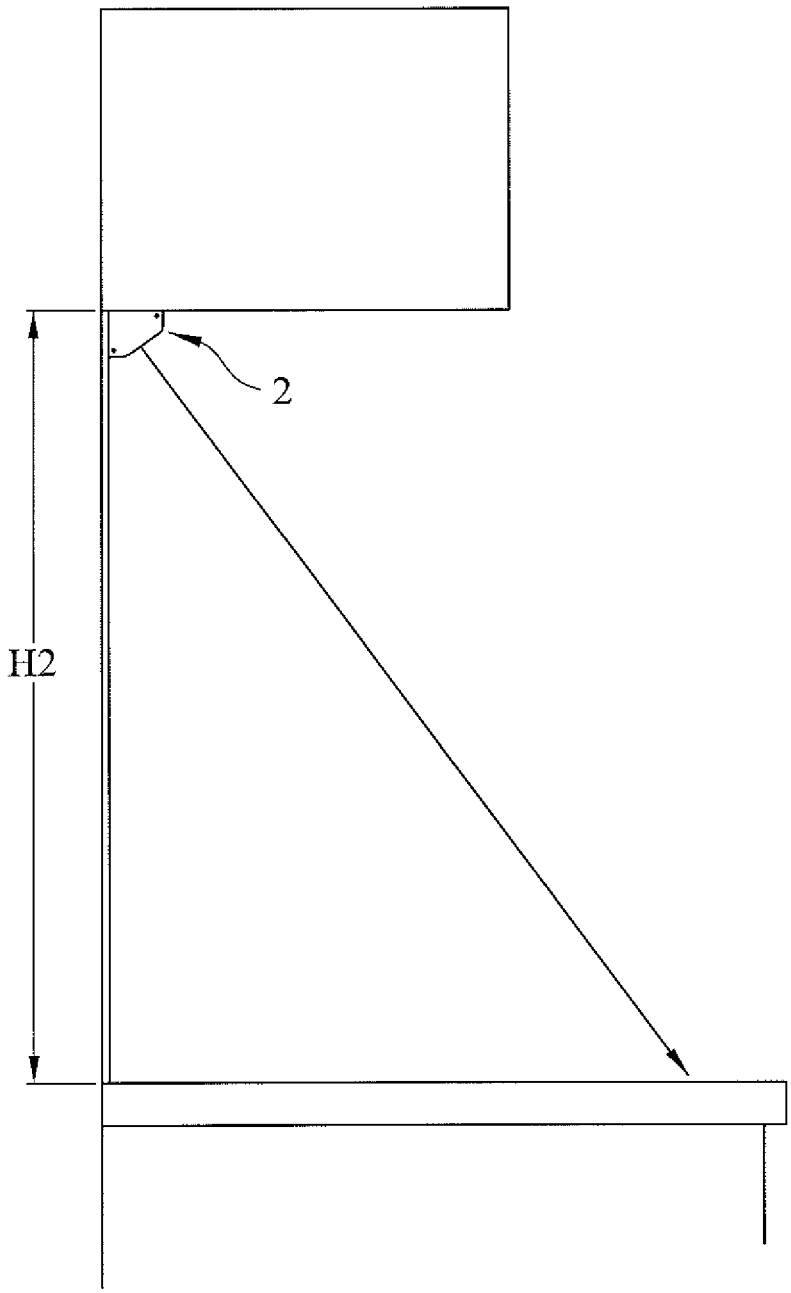

Referring to FIGS. 10 and 11, in combination with FIGS. 8 and 9, taking the sink in the kitchen as an example, according to kinds of situation for the height (H1, H2) of a working area of the sink are different, and because of the configuration of the lamp holder 22 of the present invention, by simply changing the position of the holder plate 221 of the lamp holder 22 relative to the carrier plate 31, that is, by inserting a selected one of the first and second positioning plates 222, 223 into the clamping space 325, the light emitting characteristic of the light emitting unit 23 can be easily changed, so that an almost similar light distribution area can be obtained.

Figure 5:
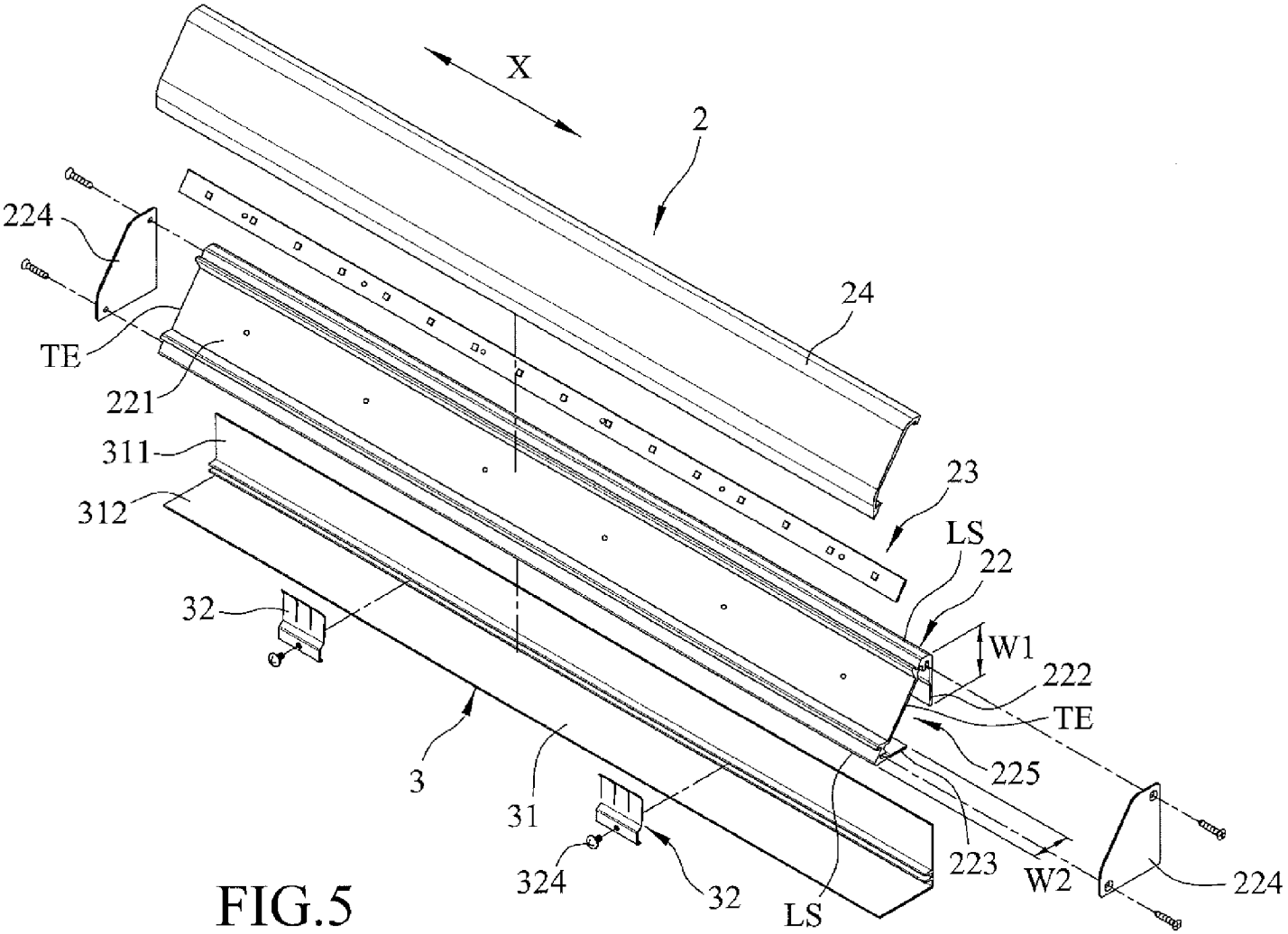
FIG. 5 is an exploded perspective view of the preferred embodiment of a lighting system according to the present invention.
Figure 12:
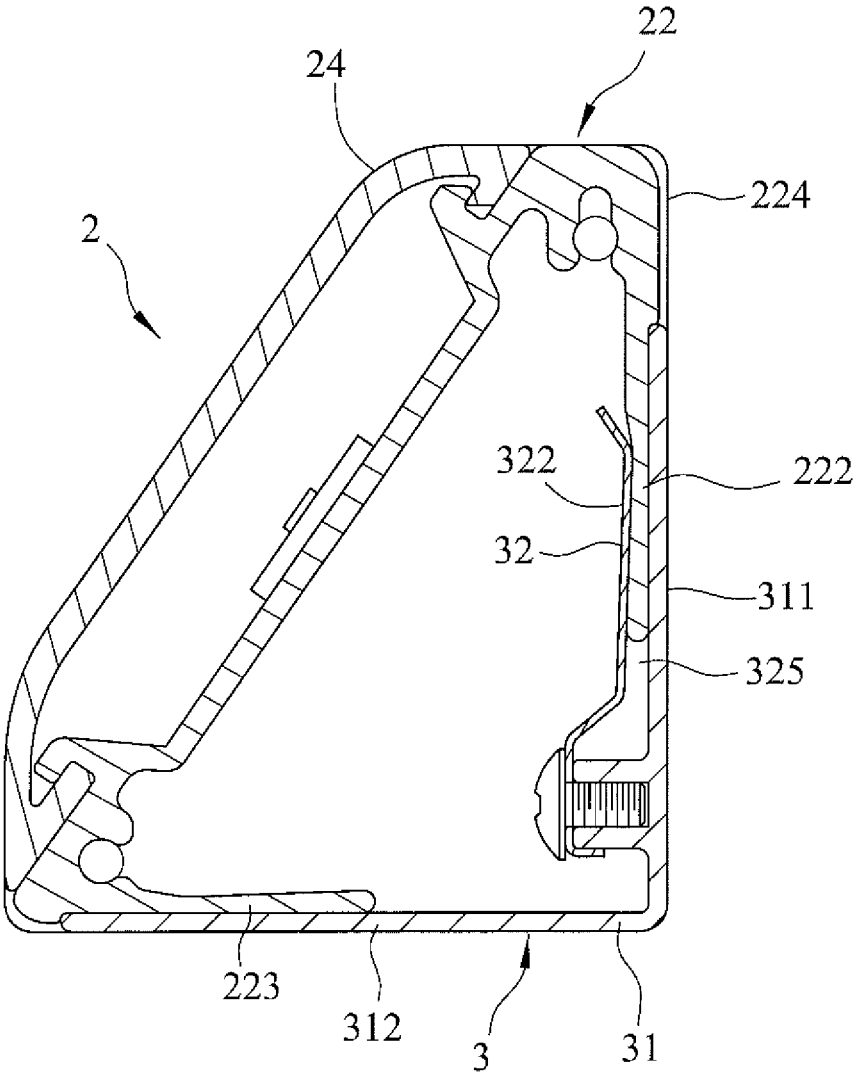
FIG. 12 is a sectional side view of the preferred embodiment.
Figure 13:
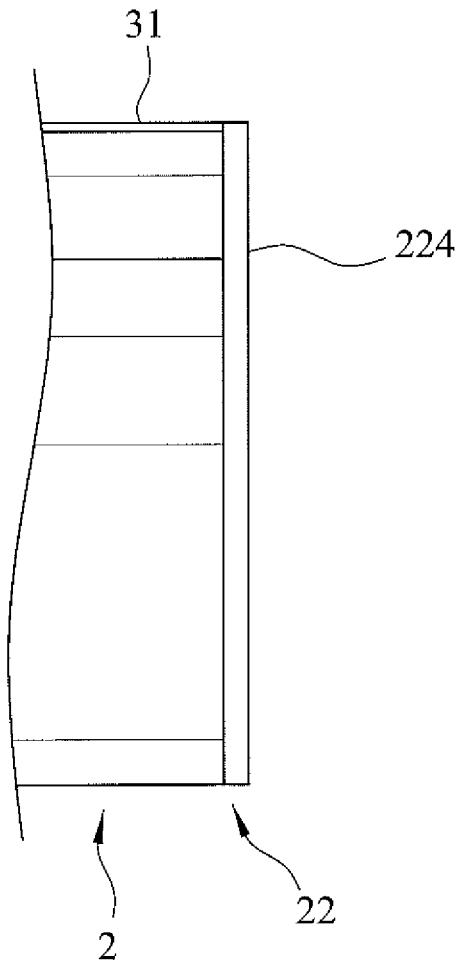
FIG. 13 is a fragmentary schematic top view of FIG. 12.

Moreover, referring to FIGS. 12 and 13, in combination with FIG. 5, because the lamp holder 22 is positioned on the carrier unit 3 through clamping, the lamp holder 22 can move along the longitudinal direction (X) relative to the carrier unit 3. The end covers 224 are removably connected to the two transverse ends (TE) of the holder plate 221. Further, each of the end covers 224 abuts against a transverse end of the first carrier plate 311 and a corresponding transverse end of the second carrier plate 312, so that movement of the lamp holder 22 relative to the carrier unit 3 along the longitudinal direction (X) can be limited.

Figure 14:
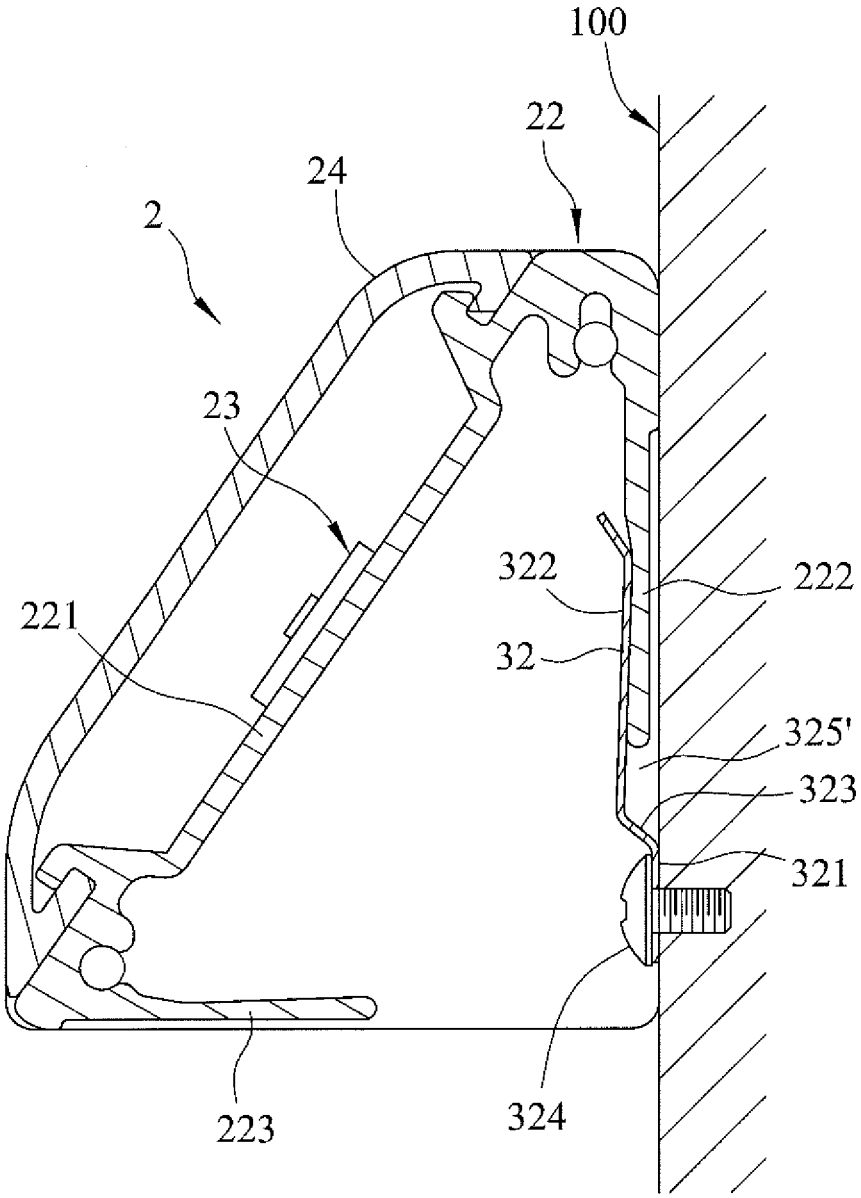
FIG. 14 illustrates how a first positioning plate of the lamp holder is clamped by a clamp unit.

FIG. 14 illustrates an alternative form of the preferred embodiment. In this embodiment, the carrier unit 3 only includes at least one clamp 32. The carrier plate 31 is dispensed herewith. The fastener 324 of the clamp 32 is engaged to a support after extending through the mounting portion 321. A wall surface 100 is exemplified as the support in this embodiment. The clamping portion 322 is spaced apart from the wall surface 100 to form the clamping space 325'. A selected one of the first and second positioning plates 222, 223 is insertable into the clamping space 325'. The effect of changing the light emitting characteristic of the light emitting unit 23 may be similarly achieved.

Figure 15:
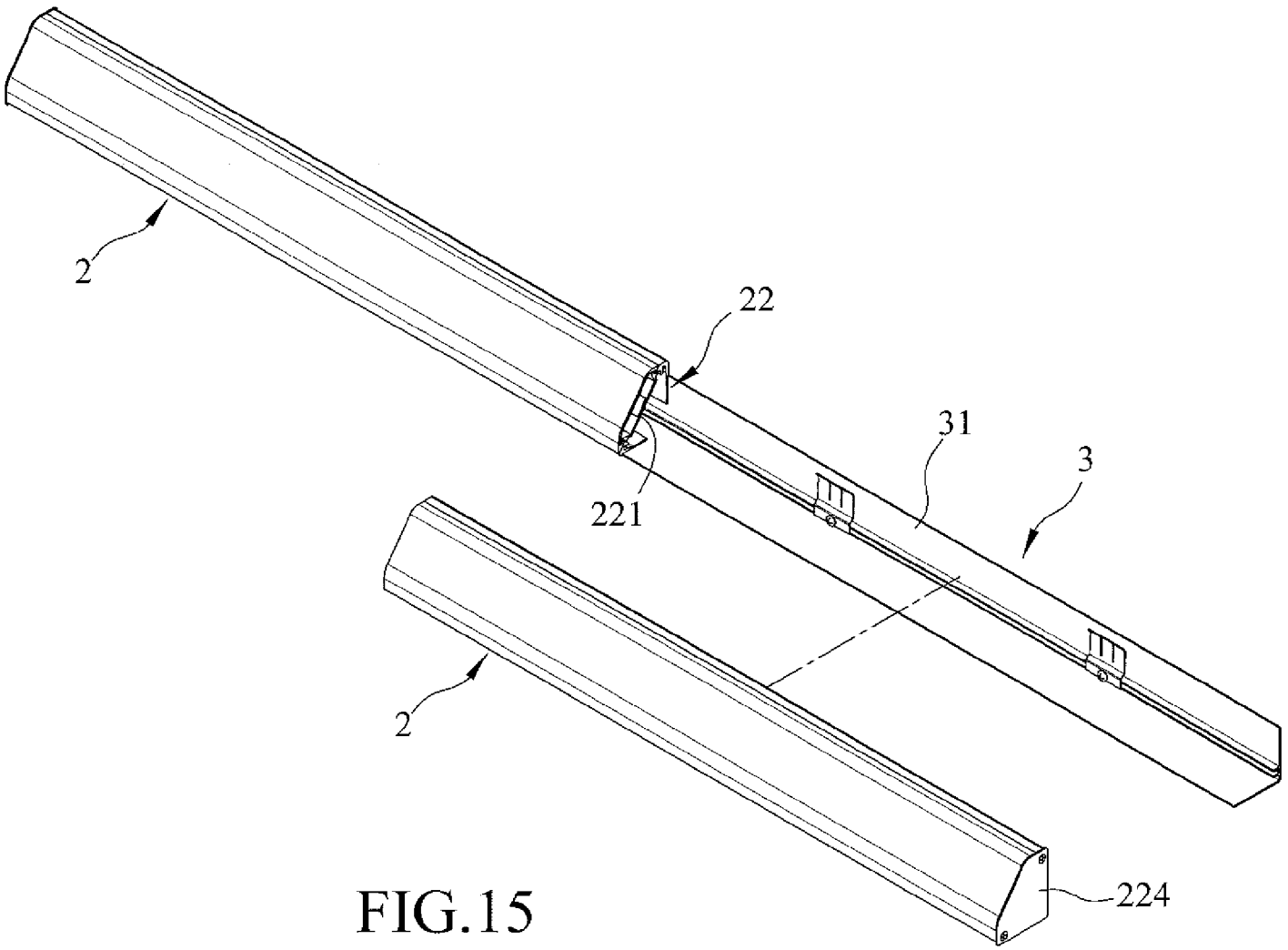
FIG. 15 is a perspective view, illustrating an alternative form of the preferred embodiment.

Referring to FIG. 15, the carrier plate 31 of the carrier unit 3 of this invention may have a predetermined length, and a plurality of the lighting devices 2 may be simultaneously mounted on and supported by the carrier plate 31. As such, the lighting system is suitable for use in different installation conditions and environments. Furthermore, the end covers 224 are of removable type, so that additional lighting devices 2 can be mounted on and supported by the carrier plate 31 when the end covers 224 are removed.

In summary, through the configurations of the first and second positioning plates 222, 223, the holder plate 221 of the lamp holder 22 of the lighting system of the present invention can be disposed between the first and second positions so as to change the light emitting characteristic of the lighting system.

Moreover, the lighting system of this invention has simple components and a simple structure, so that the manufacturing cost thereof can be saved, and the aesthetics, practicality and value of the lighting device 2 can be enhanced. Therefore, the object of this invention can be realized.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A lighting device, comprising:

a lamp holder including a holder plate, and a first positioning plate and a second positioning plate extending from said holder plate and spaced apart from each other; and a light emitting unit mounted on said holder plate;

wherein said holder plate being disposed at a first position when said first positioning plate is fastened, or being disposed at a second position when said second positioning plate is fastened, a light emitting characteristic of said light emitting unit when said holder plate is in said first position being different from a light emitting characteristic of said light emitting unit when said holder plate is in said second position, and wherein said holder plate extends in a longitudinal direction and has two opposite longitudinal sides, said first positioning plate extending longitudinally and inclinedly from one of said longitudinal sides at a first angle with respect to said holder plate, said second positioning plate extending longitudinally and inclinedly from the other one of said longitudinal sides at a second angle with respect to said holder plate, said second angle being different from said first angle.

2. The lighting device as claimed in claim 1, wherein said first positioning plate has one end connected to one of said longitudinal sides of said holder plate, and said second positioning plate has one end connected to the other one of said longitudinal sides of said holder plate, each of said first and second positioning plates further having another end opposite to said one end thereof.

3. The lighting device as claimed in claim 2, wherein each of said first and second positioning plates has a width between said one end and said another end thereof, said width of said first positioning plate being larger than that of said second positioning plate.

4. The lighting device as claimed in claim 2, wherein said another ends of said first and second positioning plates are extrapolated to intersect each other and form a right angle therebetween.

5. The lighting device as claimed in claim 1, wherein said holder plate further has two transverse ends interconnecting said longitudinal sides, said lighting device further comprising two end covers respectively and removably connected to said transverse ends of said holder plate.

6. The lighting device as claimed in claim 1, further comprising a lampshade connected to said holder plate and covering said light emitting unit.

7. A lighting system comprising:

a carrier unit; and at least one lighting device removably supported on said carrier unit and including a lamp holder including a holder plate, and a first positioning plate and a second positioning plate extending from said holder plate and spaced apart from each other, and a light emitting unit mounted on said holder plate;

wherein said first and second positioning plates are selectively and removably connected to said carrier unit, said holder plate being disposed at a first position when said first positioning plate is connected to said carrier unit, or being disposed at a second position when said second positioning plate is connected to said carrier unit, a light emitting characteristic of said light emitting unit when said holder plate is in said first position being different from a light emitting characteristic of said light emitting unit when said holder plate is in said second position, and wherein said holder plate extends in a longitudinal direction and has two opposite longitudinal sides, said first positioning plate extending longitudinally and inclinedly from one of said longitudinal sides at a first angle with respect to said holder plate, said second positioning plate extending longitudinally and inclinedly from the other one of said longitudinal sides at a second angle with respect to said holder plate, said second angle being different from said first angle.

8. The lighting system as claimed in claim 7, wherein said first positioning plate has one end connected to one of said longitudinal sides of said holder plate, and said second positioning plate has one end connected to the other one of said longitudinal sides of said holder plate, each of said first and second positioning plates further having another end opposite to said one end thereof.

9. The lighting system as claimed in claim 8, wherein each of said first and second positioning plates has a width between said one end and said another end thereof, said width of said first positioning plate being larger than that of said second positioning plate.

10. The lighting system as claimed in claim 8, wherein said another ends of said first and second positioning plates are extrapolated to intersect each other and form a right angle therebetween.

11. The lighting system as claimed in claim 7, wherein said holder plate further has two transverse ends interconnecting said longitudinal sides, said lighting device further includes two end covers respectively and removably connected to said transverse ends of said holder plate.

12. The lighting system as claimed in claim 7, wherein said carrier unit includes a clamp, said clamp including a mounting portion, a clamping portion offset from said mounting portion, a bent portion interconnecting said clamping portion and said mounting portion, and a fastener extending through said mounting portion for connection with a support, said clamping portion being capable of forming a clamping space, a selected one of said first and second positioning plates being insertable into said clamping space.

13. The lighting system as claimed in claim 11, wherein said carrier unit includes a carrier plate extending in the longitudinal direction, having an L-shaped cross section, and including first and second carrier plates angled to each other, said first carrier plate being used for connection with a support, said carrier unit further including a clamp, said clamp including a mounting portion, a clamping portion offset from said mounting portion, a bent portion interconnecting said clamping portion and said mounting portion, and a fastener extending through said mounting portion and engaged to said first carrier plate, said clamping portion being spaced apart from said first carrier plate to form a clamping space, a selected one of said first and second positioning plates being insertable into said clamping space.

14. The lighting system as claimed in claim 13, wherein each of said end covers abuts against a transverse end of said first carrier plate and a corresponding transverse end of said second carrier plate.

15. The lighting system as claimed in claim 7, wherein said lighting device further includes a lampshade connected to said holder plate and covering said light emitting unit.

16. The lighting system as claimed in claim 13, wherein said carrier plate has a predetermined length, and a plurality of said lighting devices are supported on said carrier plate.

17. A lamp holder comprising:

a holder plate; and a first positioning plate; and a second positioning plate extending from said holder plate and spaced apart from said first positioning plate;

wherein said holder plate being disposed at a first position when said first positioning plate is fastened, or being disposed at a second position which is different from the first position when said second positioning plate is fastened, and wherein said holder plate extends in a longitudinal direction and has two opposite longitudinal sides and two opposite transverse ends interconnecting said longitudinal sides, said first positioning plate extending longitudinally and inclinedly from one of said longitudinal sides at a first angle with respect to said holder plate, said second positioning plate extending longitudinally and inclinedly from the other one of said longitudinal sides at a second angle with respect to said holder plate, said second angle being different from said first angle.

* * * * *